US011362465B2

(12) United States Patent
Li et al.

(10) Patent No.: US 11,362,465 B2
(45) Date of Patent: Jun. 14, 2022

(54) RADIO-FREQUENCY CONNECTOR ASSEMBLY

(71) Applicant: SUNWAY COMMUNICATION (JIANGSU) CO., LTD., Jiangsu (CN)

(72) Inventors: Ren-Chih Li, Changzhou (CN); Stanley Wang, Changzhou (CN)

(73) Assignee: SUNWAY COMMUNICATION (JIANGSU) CO., LTD., Changzhou (CN)

( * ) Notice: Subject to any disclaimer, the term of this patent is extended or adjusted under 35 U.S.C. 154(b) by 139 days.

(21) Appl. No.: 16/755,235

(22) PCT Filed: Jan. 8, 2020

(86) PCT No.: PCT/CN2020/070969

§ 371 (c)(1),
(2) Date: Apr. 10, 2020

(87) PCT Pub. No.: WO2021/077633

PCT Pub. Date: Apr. 29, 2021

(65) Prior Publication Data

US 2021/0408731 A1 Dec. 30, 2021

(30) Foreign Application Priority Data

Oct. 24, 2019 (CN) ..... 201911018386.8

(51) Int. Cl.
*H01R 13/6582* (2011.01)
*H01R 12/71* (2011.01)
(Continued)

(52) U.S. Cl.
CPC ..... *H01R 13/6582* (2013.01); *H01R 12/716* (2013.01); *H01R 13/6461* (2013.01);
(Continued)

(58) Field of Classification Search
CPC .... H01R 12/52; H01R 12/714; H01R 12/775; H01R 12/57; H01R 12/62; H01R 12/712;
(Continued)

(56) References Cited

U.S. PATENT DOCUMENTS 8,043,114 B2 * 10/2011 Kaneko ..... H01R 12/775 439/468

FOREIGN PATENT DOCUMENTS

CN 109103629 A * 12/2018

* cited by examiner

*Primary Examiner* — Abdullah A Riyami
*Assistant Examiner* — Justin M Kratt
(74) *Attorney, Agent, or Firm* — Oliff PLC

(57) ABSTRACT

A radio-frequency connector assembly includes a radio-frequency line, connector male terminals, connector female terminals, and a circuit board, wherein each connector male terminal includes a male terminal substrate; each connector female terminal includes a female terminal substrate; the connector male terminal further includes a shielding case which shields the male terminal substrate and is conductive with the radio-frequency line in a grounding manner; and the connector female terminal further includes a shielding frame which is internally provided with the female terminal substrate and is circumferentially seamless entirely, and the bottom end of the shielding frame makes contact with the circuit board to form an annular contact region, so that signals of the connector female terminals will not leak sideways; and the shielding cases can prevent signal leakage and signal interference from the top of the shielding frame, so that matched signal terminals are kept in a fully-shielded operating environment.

9 Claims, 3 Drawing Sheets

(51) Int. Cl.

| | |
|---|---|
| ***H01R 13/6461*** | (2011.01) |
| ***H01R 13/6585*** | (2011.01) |
| ***H01R 13/6594*** | (2011.01) |
| ***H01R 24/40*** | (2011.01) |
| *H01R 13/648* | (2006.01) |
| *H01R 13/658* | (2011.01) |
| *H01R 13/6581* | (2011.01) |
| *H01R 12/57* | (2011.01) |
| *H01R 12/52* | (2011.01) |
| *H01R 12/62* | (2011.01) |
| *H01R 12/77* | (2011.01) |
| *H01R 13/646* | (2011.01) |

(52) U.S. Cl.
CPC ..... *H01R 13/6585* (2013.01); *H01R 13/6594* (2013.01); *H01R 24/40* (2013.01); *H01R 12/52* (2013.01); *H01R 12/57* (2013.01); *H01R 12/62* (2013.01); *H01R 12/712* (2013.01); *H01R 12/714* (2013.01); *H01R 12/775* (2013.01); *H01R 13/646* (2013.01); *H01R 13/648* (2013.01); *H01R 13/658* (2013.01); *H01R 13/6581* (2013.01)

(58) Field of Classification Search
CPC ..... H01R 13/646; H01R 13/6582; H01R 12/716; H01R 13/6461; H01R 13/6585; H01R 13/6594; H01R 24/40; H01R 13/648; H01R 13/658; H01R 13/6581
See application file for complete search history.

RADIO-FREQUENCY CONNECTOR ASSEMBLY

TECHNICAL FIELD

The invention relates to the technical field of signal transmission assemblies, in particular to a radio-frequency connector assembly.

DESCRIPTION OF RELATED ART

Radio-frequency connector assemblies typically comprise a radio-frequency line, a connector male terminal, a connector female terminal, and a circuit board, wherein the radio-frequency line is conductively connected to the connector male terminal to form a connector male terminal assembly, and the connector female terminal is installed on the circuit board to form a connector female terminal assembly; the connector male terminal includes a male terminal substrate and a male signal terminal arranged on the male terminal substrate; and the connector female terminal includes a female terminal substrate and a female signal terminal arranged on the female terminal substrate.

Existing radio-frequency connector assemblies have the problems of electric field leakage and signal interference, which severely affect the electrical performance of the radio-frequency connector assemblies.

BRIEF SUMMARY

The technical issue to be settled by the invention is to provide a radio-frequency connector assembly having good electrical performance.

The technical solution adopted by the invention to settle the above-mentioned technical issue is as follows: a radio-frequency connector assembly comprises a radio-frequency line, connector male terminals, connector female terminals, and a circuit board, wherein each connector male terminal includes a male terminal substrate; each connector female terminal includes a female terminal substrate; the connector male terminal further includes a shielding case which shields the male terminal substrate and is conductive with the radio-frequency line in a grounding manner; and the connector female terminal further includes a shielding frame which is internally provided with the female terminal substrate and is circumferentially seamless entirely, and the bottom end of the shielding frame makes contact with the circuit board to form an annular contact region.

The invention has the following beneficial effects: the shielding frames are circumferentially seamless entirely, and the bottom ends of the shielding frames make contact with the circuit board to form the annular contact regions, so that signals of the connector female terminals will not leak sideways; and the shielding cases can prevent signal leakage and signal interference from the top of the shielding frames, so that male signal terminals and female signal terminals matched with the male signal terminals are kept in a fully-shielded operating environment, the shielding performance of the radio-frequency connector assembly is effectively improved, and excellent electrical performance of the radio-frequency connector assembly is fulfilled.

REFERENCE SIGNS

1, radio-frequency line;
2, connector male terminal;
3, connector female terminal;
4, circuit board;
5, male terminal substrate;
6, female terminal substrate;
7, shielding case;
8, shielding frame;
9, grounding conduction region;
10, edge guard;
11, top plate;
12, peripheral plate;
13, line inlet;
14, male signal terminal;
15, female signal terminal;
16, spacer;
17, gap.

DETAILED DESCRIPTION

The technical contents, purposes, and effects of the invention are expounded as follows in combination with the embodiments and accompanying drawings.

Figure 1:
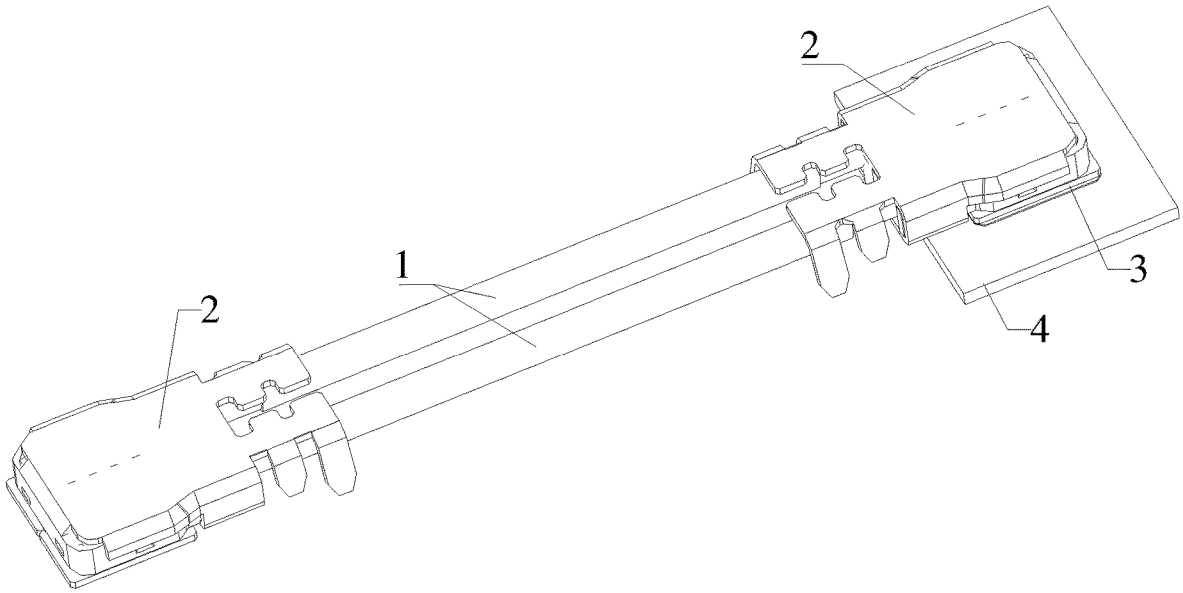
FIG. 1 is a structural view of a radio-frequency connector assembly in Embodiment 1 of the invention.
Figure 2:
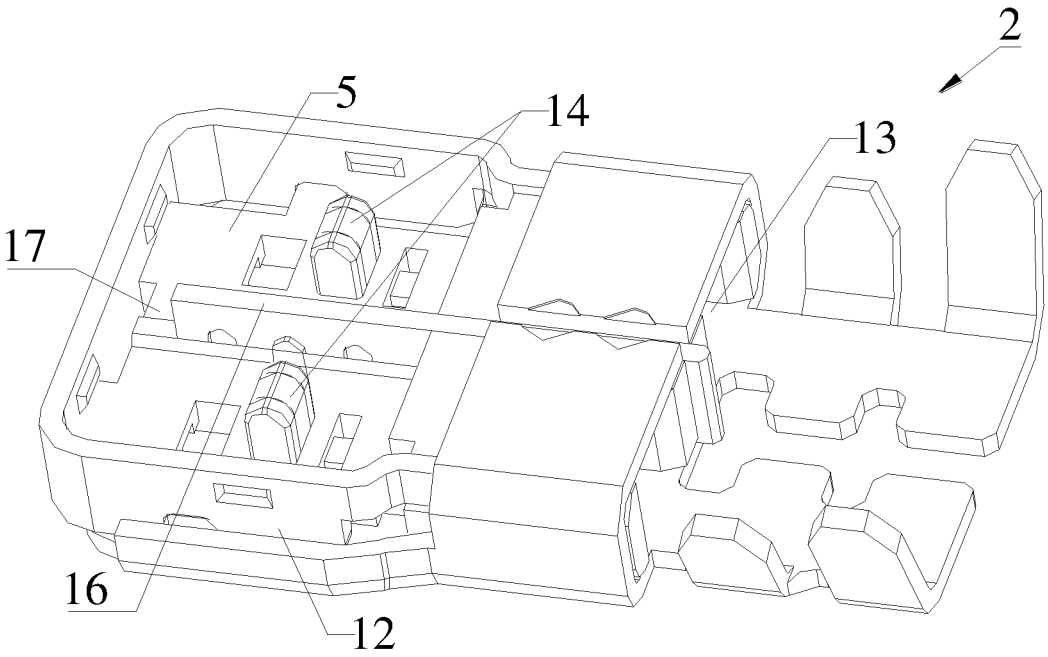
FIG. 2 is a structural view of a connector male terminal of the radio-frequency connector assembly in Embodiment 1 of the invention.
Figure 3:
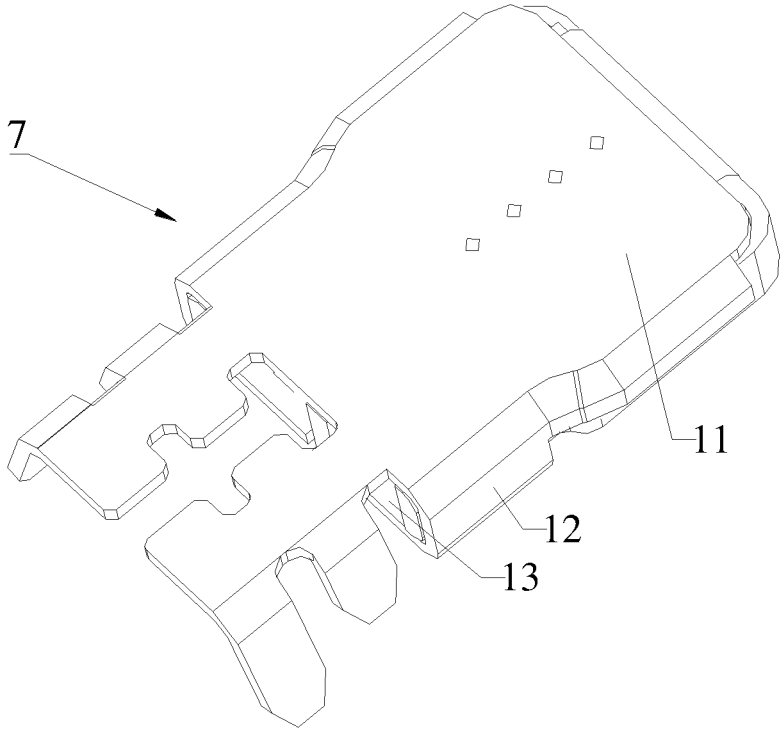
FIG. 3 is a structural view of a shielding case of the radio-frequency connector assembly in Embodiment 1 of the invention.
Figure 4:
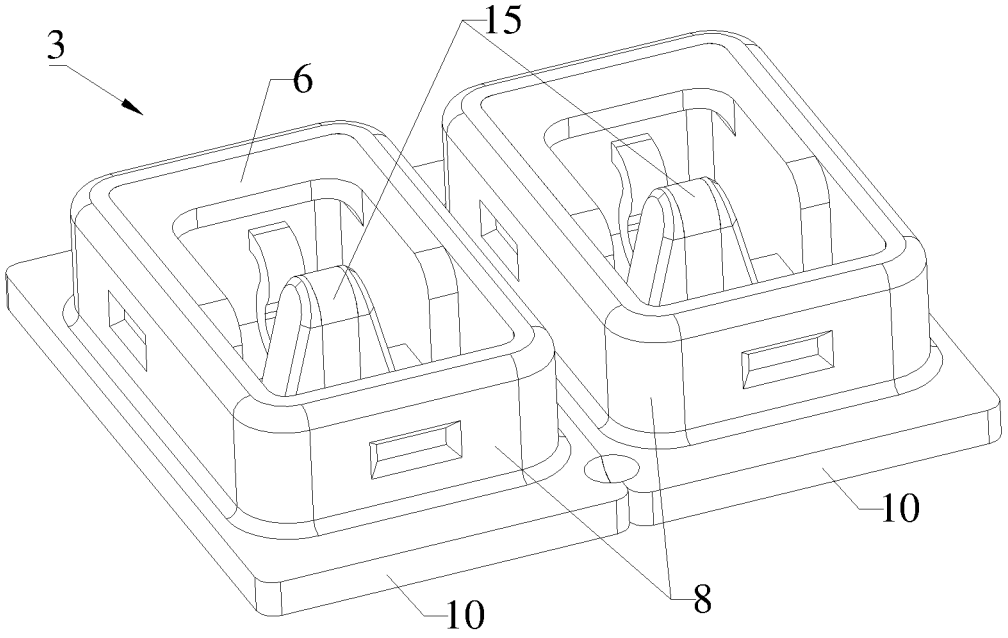
FIG. 4 is a structural view of a connector female terminal of the radio-frequency connector assembly in Embodiment 1 of the invention.
Figure 5:
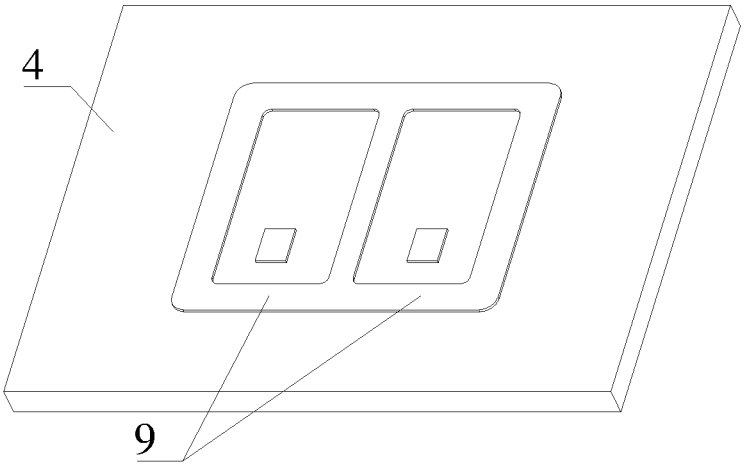
FIG. 5 is a simplified view of a circuit board of the radio-frequency connector assembly in Embodiment 1 of the invention.

Referring to FIG. 1 to FIG. 5, a radio-frequency connector assembly comprises a radio-frequency line 1, connector male terminals 2, connector female terminals 3, and a circuit board 4, wherein each connector male terminal 2 includes male terminal substrates 5; each connector female terminal 3 includes female terminal substrates 6; the connector male terminal 2 further includes a shielding case 7 which shields the male terminal substrates 5 and is conductive with the radio-frequency line 1 in a grounding manner; and the connector female terminal 3 further includes a shielding frame 8 which is internally provided with the female terminal substrate 6 and is circumferentially seamless entirely, and the bottom end of the shielding frame 8 makes contact with the circuit board 4 to form an annular contact region.

From the above description, the invention has the following beneficial effects: the shielding frames 8 are circumferentially seamless entirely, and the bottom ends of the shielding frames 8 make contact with the circuit board 4 to form the annular contact regions, so that signals of the connector female terminals 3 will not leak sideways; and the shielding cases 7 can prevent signal leakage and signal interference from the top of the shielding frames 8, so that male signal terminals 14 and female signal terminals 15 matched with the male signal terminals 14 are kept in a fully-shielded operating environment, the shielding performance of the radio-frequency connector assembly is effectively improved, and excellent electrical performance of the radio-frequency connector assembly is fulfilled.

Furthermore, the contact regions are grounding conduction regions 9 of the shielding frames 8 and the circuit board 4.

From the above description, closed annular grounding regions are formed between the shielding frames 8 and the circuit board 4 to thoroughly eliminate the risk of signal leakage via small gaps between the shielding frames 8 and the circuit board 4, so that the shielding performance of the radio-frequency connector assembly is further improved, and the electrical performance of the radio-frequency connector assembly is optimized.

Furthermore, the shielding cases 7 are conductive with the shielding frames 8.

From the above description, after the connector male terminals 2 are connected to the connector female terminals 3, the shielding cases 7 are conductive with the shielding frames 8 to form double-layer shielding structures, so that the shielding performance and electrical performance of the radio-frequency connector assembly are improved.

Furthermore, the bottom ends of the shielding frames 8 have outwards-extending edge guards 10, and the bottom ends of the shielding cases 7 abut against the top faces of the edge guards 10.

From the above description, the edge guards 10 can increase the conductive area of the shielding frames 8 and the circuit board 4, so that the risk of signal leakage is further reduced; and the bottom ends of the shielding cases 7 abut against the top faces of the edge guards 10 to optimize the double-layer shielding structure, so that the shielding performance and electrical performance of the radio-frequency connector assembly are further improved.

Furthermore, each shielding case 7 includes a top plate 11 having an edge provided with a peripheral plate 12 which has a line inlet 13 and is circumferentially closed entirely.

From the above description, the shielding case 7 of the above structure can greatly improve the shielding performance of the connector male terminals 2, so that the electrical performance of the radio-frequency connector assembly is further improved.

Furthermore, each male terminal substrate 5 is provided with a male signal terminal 14, and each female terminal substrate 6 is provided with a female signal terminal 15 matched with the male signal terminal 14.

From the above description, the coaxial radio-frequency connector assembly is a signal transmission assembly having one signal channel.

Furthermore, the male terminal substrate 5 is provided with a plurality of male signal terminals 14, and every two adjacent male signal terminals 14 are isolated by means of a spacer 16 conductive with one shielding case 7; a plurality of female terminal substrates 6 and a plurality of shielding frames 8 are arranged in each connector female terminal 3, and the female terminal substrates 6 are in one-to-one correspondence with the shielding frames 8; and each female terminal substrate 6 is provided with a female signal terminal 15 matched with one male signal terminal 14, every two adjacent shielding frames 8 are fixedly connected, and the spacer 16 is inserted between every two adjacent shielding frames 8 to prevent signal interference between the signal terminals.

From the above description, the coaxial radio-frequency connector assembly is a signal transmission assembly having a plurality of signal channels in different fully-shielded structures, so that the shielding performance of the radio-frequency connector assembly is greatly improved, and the electrical performance of the radio-frequency connector assembly is optimized.

Furthermore, the spacer 16 is conductively in contact with the shielding frames 8 on two sides of the spacer 16.

From the above description, the signal interference between every two adjacent signal terminals can be further isolated, so that the electrical performance of the radio-frequency connector assembly is improved.

Furthermore, the shielding case 7 includes the top plate 11 which is conductively in contact with all regions of the top face of the spacer 16.

From the above description, the spacer 16 is stably conductive with the shielding case 7 and can better isolate the signal interference between every two adjacent male signal terminals 14.

Furthermore, the spacer 16 and the male terminal substrate 5 are integrally formed by injection molding through an insert.

From the above description, the spacer 16 is stably connected to the male terminal substrate 5.

Furthermore, the peripheral plate 12 is arranged on the edge of the top plate 11, has a line inlet 13, and is circumferentially closed entirely, and a gap 17 is formed between the front face of the spacer 16 and the peripheral plate 12; or, at least one part of the front face of the spacer 16 conductively abuts against the peripheral plate 12.

From the above description, when the gap 17 is formed between the front face of the spacer 16 and the peripheral plate 12, the male terminal substrate 5 can be conveniently formed, and the processing difficulty of the connector male terminals 2 can be lowered; and when at least one part of the front face of the spacer 16 conductively abuts against the peripheral plate 12, the shielding performance of the connector assembly can be further improved.

Embodiment 1

Referring to FIG. 1 to FIG. 5, Embodiment 1 of the invention is as follows: a radio-frequency connector assembly comprises a radio-frequency line 1, connector male terminals 2, connector female terminals 3, and a circuit board 4, wherein each connector male terminal 2 includes male terminal substrates 5; each connector female terminal 3 includes female terminal substrates 6; the connector male terminal 2 further includes a shielding case 7 which shields the male terminal substrates 5 and is conductive with the radio-frequency line 1 in a grounding manner; the connector female terminal 3 further includes shielding frames 8 which are internally provided with the female terminal substrates 6 and are circumferentially seamless entirely; understandably, the shielding frames 8 which are circumferentially seamless entirely can be fabricated by means of a drawing process, a cold forging process, a powder metallurgy process, or the like; and the bottom ends of the shielding frames 8 make contact with the circuit board 4 to form annular contact regions. Preferably, the contact regions are grounding conduction regions 9 of the shielding frames 8 and the circuit board 4.

After the connector male terminals 2 are connected to the connector female terminals 3, the shielding cases 7 are preferably conductive with the shielding frames 8; and optionally, the shielding cases 7 are connected to the shielding frames 8 in a buckling manner to be conductive with the shielding frames 8.

Furthermore, the bottom ends of the shielding frames 8 have outwards-extending edge guards 10, the bottom ends of the shielding cases 7 abut against the top faces of the edge guards 10, and the bottom ends of the edge guards 10 make contact with the circuit board 4.

Particularly, each shielding case 7 includes a top plate 11 having an edge provided with a peripheral plate 12 which has a line inlet 13 and is circumferentially closed entirely; and the shielding case 7 can shield regions other than the line inlet 13 in multiple directions to effectively prevent signal leakage and signal interference, so that the shielding effect of the radio-frequency connector assembly is improved.

In this embodiment, each male terminal substrate 5 is provided with a male signal terminal 14, and each female terminal substrate 6 is provided with a female signal terminal 15 matched with the male signal terminal 14. That is, the radio-frequency connector assembly in this embodiment is a signal transmission assembly having one signal channel.

Embodiment 2

Referring to FIG. 1 to FIG. 5, Embodiment 2 of the invention is as follows: a radio-frequency connector assembly comprises a radio-frequency line 1, connector male terminals 2, connector female terminals 3, and a circuit board 4, wherein each connector male terminal 2 includes male terminal substrates 5; each connector female terminal 3 includes female terminal substrates 6; the connector male terminal 2 further includes a shielding case 7 which shields the male terminal substrates 5 and is conductive with the radio-frequency line 1 in a grounding manner; the connector female terminal 3 further includes shielding frames 8 which are internally provided with the female terminal substrates 6 and are circumferentially seamless entirely; understandably, the shielding frames 8 which are circumferentially seamless entirely can be fabricated by means of a drawing process, a cold forging process, a powder metallurgy process, or the like; and the bottom ends of the shielding frames 8 make contact with the circuit board 4 to form annular contact regions. Preferably, the contact regions are grounding conduction regions 9 of the shielding frames 8 and the circuit board 4.

After the connector male terminals 2 are connected to the connector female terminals 3, the shielding cases 7 are preferably conductive with the shielding frames 8; and optionally, the shielding cases 7 are connected to the shielding frames 8 in a buckling manner to be conductive with the shielding frames 8.

Furthermore, the bottom ends of the shielding frames 8 have outwards-extending edge guards 10, and the bottom ends of the shielding cases 7 abut against the top faces of the edge guards 10.

Particularly, each shielding case 7 includes a top plate 11 having an edge provided with a peripheral plate 12 which has a line inlet 13 and is circumferentially closed entirely; and the shielding case 7 can shield regions other than the line inlet 13 in multiple directions to effectively prevent signal leakage and signal interference, so that the shielding effect of the radio-frequency connector assembly is improved.

The radio-frequency connector assembly in this embodiment is a signal transmission assembly having a plurality of signal channels. Particularly, each male terminal substrate 5 is provided with a plurality of male signal terminals 14, and every two adjacent male signal terminals 14 are isolated by means of a spacer 16 conductive with one shielding case 7; a plurality of female terminal substrates 6 and a plurality of shielding frames 8 are arranged in each connector female terminal 3, and the female terminal substrates 6 are in one-to-one correspondence with the shielding frames 8; and each female terminal substrate 6 is provided with a female signal terminal 15 matched with one male signal terminal 14, every two adjacent shielding frames 8 are fixedly connected, and the spacer 16 is inserted between every two adjacent shielding frames 8 to prevent signal interference between the signal terminals. Understandably, "between the signal terminals" mentioned herein refers to "between one male signal terminal and another male signal terminal", "between one female signal terminal and another female signal terminal", and "between one male signal terminal and one female signal terminal not matched with the male signal terminal". Preferably, every two adjacent shielding frames 8 are conductively fixed.

In this embodiment, the spacer 16 is fixed to the male terminal substrate 5. Preferably, the spacer 16 and the male terminal substrate 5 are integrally formed by injection molding through an insert, thus facilitating processing.

In order to further improve the shielding effect of the radio-frequency connector assembly, after the connector male terminals 2 and the connector female terminals 3 are cooperatively plugged, the spacer 16 is conductively in contact with the shielding frames 8 on two sides of the spacer 16.

In order to make the spacer 16 stably conductive with the shielding case 7 to fulfill good isolation of every two adjacent male signal terminals 14, all regions of the top face of the spacer 16 are conductively in contact with the top plate 11.

In this embodiment, in order to facilitate the formation of the male terminal substrate 5 and lower the processing difficulty of the connector male terminals 2, a gap 17 is formed between the front face of the spacer 16 and the peripheral plate 12. In order to further improve the shielding performance of the radio-frequency connector assembly, at least one part of the front face of the spacer 16 conductively abut against the peripheral plate 12, optionally.

In conclusion, according to the radio-frequency connector assembly of the invention, each group of matched male/female signal terminals can be kept in different fully-shielded operating environments, so that the shielding performance of the radio-frequency connector assembly is effectively improved, and excellent electrical performance of the radio-frequency connector assembly is fulfilled.

The above embodiments are only illustrative ones of the invention, and are not intended to limit the patent scope of the invention. All equivalent transformations obtained on the basis of the contents in the specification and the accompanying drawings of the invention, or direct or indirect applications to related technical fields should also fall within the patent protection scope of the invention.

The invention claimed is:

1. A radio-frequency connector assembly, comprising a radio-frequency line, connector male terminals, connector female terminals, and a circuit board, wherein:

each said connector male terminal includes a male terminal substrate;

each said connector female terminal includes a female terminal substrate;

each said connector male terminal further includes a shielding case which shields the male terminal substrate and is conductive with the radio-frequency line in a grounding manner;

each said connector female terminal further includes a shielding frame which is internally provided with the female terminal substrate and is circumferentially seamless entirely, and a bottom end of the shielding frame makes contact with the circuit board to form an annular contact region; and the bottom end of the shielding frame has an outwards-extending edge guard, and when the female terminals are connected to the male terminals, a bottom end of the shielding case abuts against a top face of the edge guard.

2. The radio-frequency connector assembly according to claim 1, wherein the contact region is a grounding conduction region of the shielding frame and the circuit board.

3. The radio-frequency connector assembly according to claim 1, wherein the shielding case is conductive with the shielding frame.

4. The radio-frequency connector assembly according to claim 1, wherein the shielding case includes a top plate having an edge provided with a peripheral plate which has a line inlet and is circumferentially closed entirely.

5. The radio-frequency connector assembly according to claim 1, wherein the male terminal substrate is provided with a male signal terminal, and the female terminal substrate is provided with a female signal terminal matched with the male signal terminal.

6. The radio-frequency connector assembly according to claim 1, wherein:

the male terminal substrate is provided with a plurality of male signal terminals, and every two adjacent said male signal terminals are isolated by means of a spacer conductive with the shielding case;

a plurality of female terminal substrates and a plurality of shielding frames are arranged in the connector female terminal, and the female terminal substrates are in one-to-one correspondence with the shielding frames; and each said female terminal substrate is provided with a female signal terminal matched with one said male signal terminal, every two adjacent said shielding frames are fixedly connected, and the spacer is inserted between every two adjacent said shielding frames to prevent signal interference between the signal terminals.

7. The radio-frequency connector assembly according to claim 6, wherein the spacer is conductively in contact with the shielding frames on two sides of the spacer.

8. The radio-frequency connector assembly according to claim 6, wherein the shielding case includes a top plate conductively in contact with all regions of a top face of the spacer.

9. The radio-frequency connector assembly according to claim 8, wherein a peripheral plate is arranged at an edge of the top plate, has a line inlet, and is circumferentially closed entirely, and a gap is formed between a front face of the spacer and the peripheral plate; or, at least one part of the front face of the spacer conductively abuts against the peripheral plate.

* * * * *